United States Patent [19]

Escher

[11] 4,257,923

[45] Mar. 24, 1981

[54] SUBSTITUTED DELTA-LACTONES IN PERFUME COMPOSITIONS

[75] Inventor: Sina D. Escher, Le Lignon, Switzerland

[73] Assignee: Firmenich SA, Geneva, Switzerland

[21] Appl. No.: 75,417

[22] Filed: Sep. 14, 1979

[30] Foreign Application Priority Data

Sep. 29, 1978 [CH] Switzerland ..... 10174/78

[51] Int. Cl.[3] ..... E11B 9/00

[52] U.S. Cl. ..... 252/522 R; 252/174.11

[58] Field of Search ..... 252/522 R

[56] References Cited

U.S. PATENT DOCUMENTS

| | | | |
|---|---|---|---|
| 3,380,457 | 4/1968 | Schumacher et al. | 131/267 |
| 3,996,170 | 12/1976 | Shuster et al. | 252/522 R |

OTHER PUBLICATIONS

Chem. Ab. 69: 35352t, 1968.

*Primary Examiner*—Veronica O'Keefe

*Attorney, Agent, or Firm*—Pennie & Edmonds

[57] ABSTRACT

Substituted delta-lactones, viz. 6-ethyl- and 6-n-butyl-5,6-dihydro-2H-pyran-2-one, presents useful odorous properties and can be advantageously used as perfuming ingredients.

1 Claim, No Drawings

SUBSTITUTED DELTA-LACTONES IN PERFUME COMPOSITIONS

SUMMARY OF THE INVENTION

The present invention relates to a method for enhancing, improving or modifying the odorous properties of perfumes and perfumed products which comprises adding thereto a perfuming effective amount of 6-ethyl-5,6-dihydro-2H-pyran-2-one or 6-n-butyl-5,6-dihydro-2H-pyran-2-one.

This invention provides further a perfume, perfume base or perfumed article which comprises having added thereto an effective amount of 6-ethyl-5,6-dihydro-2H-pyran-2-one or 6-n-butyl-5,6-dihydro-2H-pyran-2-one.

BACKGROUND OF THE INVENTION

Among the great variety of lactone derivatives which have found sofar an industrial application in the field of perfumery, there appear to be numerous γ- and δ-lactones whose odorous properties could be defined as being of fatty, coco-nut, flowery and fruity type. Some lactones are further characterized by an odour reminiscent of vegetable, celery in particular, or lovage [see: S. Arctander, Perfume and Flavor Chemicals, Montclair U.S.A. (1969), Secs. 416, 828, 829, 1102, 1103, 1504, 1590, 1648 etc.]. Specific examples of such derivatives are indicated for instance in U.S. Pat. No. 3,380,457 which document describes the use of lactones having generic formula

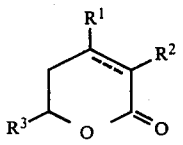

(I)

comprising a single or a double bond in the position indicated by the dotted lines, and wherein each of substituents $R^1$, $R^2$ and $R^3$ represents a hydrogen atom or an alkyl radical, as flavouring agents for tobacco products. The following compounds have been disclosed in the cited U.S. patent as being derivatives of special interest:

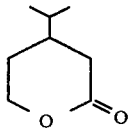

(Ia)

3-isopropyl-δ-valerolactone;

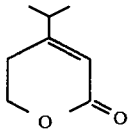

(Ib)

δ-lactone of 5-hydroxy-3-isopropyl-pent-2-enoic acid;

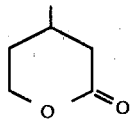

(Ic)

p-methyl-δ-valerolactone.

U.S. Pat. No. 3,996,170 describes the use as perfuming agents of lactones of formula

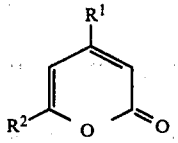

(II)

wherein $R^1$ represents a methyl radical or a hydrogen atom, and $R^2$ represents an alkyl group containing 3 to 5 carbon atoms. Said lactones of formula (II) possess notes as varied as sweet, floral, herbal, green, celery-like, coconut, coumarin, lovage-like, foenugreek, tagette.

When we have tried to repeat the process for the preparation of 6-n-butyl-alpha-pyrone—the compound of formula (II) wherein $R^1$=H and $R^2$=n-butyl—in accordance with the disclosure of cited U.S. Pat. No. 3,996,170, we have noticed that the obtained substance polymerized rapidly at room temperature, it became yellow and its smell gradually changed and denaturated.

We have now discovered that two compounds of analogous structure viz. 6-ethyl- and 6-n-butyl-5,6-dihydro-2H-pyran-2-one, possessed very useful odorous properties and consequently could be advantageously used in the perfume industry. The two compounds cited above presented, in contradistinction to the mentioned 6-n-butyl-alpha-pyrone, a constant and homogeneous odorous note; moreover, the lactonic-celery character of 6-n-butyl-alpha-pyrone is practically absent in the two compounds of the invention, whose character is more spicy and fruity. Owing to their properties, 6-ethyl- and 6-n-butyl-5,6-dihydro-2H-pyran-2-one find a particular application in the compounding of composition of fougere, chypre, lavender or even fruity type.

PREFERRED EMBODIMENTS OF THE INVENTION

Depending on the nature of the perfumed materials or on the effect desired, the proportions used may vary within a wide range and may be, for example, of the order of about 1 or 2% by weight, based on the total weight of said perfumed materials or composition into which they are incorporated. These values of concentrations can however be increased up to 15 or 20% according to the particular application under consideration.

6-Ethyl- and 6-n-butyl-5,6-dihydro-2H-pyran-2-one are known compounds; however, the prior art does not disclose nor suggest their utility as perfumants [see e.g. Chim. Ind. (Milan), 50, 194–6(1968) as reported in Chem. Abstrs. 69, 35352 t (1968); Rec. Trav. Chim. Pays-Bas 86, 504 (1967)].

The invention is better illustrated by the following examples.

EXAMPLE 1

A base perfume composition of fruity type was prepared by mixing together the following ingredients (parts by weight):

| | |
|---|---|
| Cinnamyl isobutyrate | 500 |
| HEDIONE ®* | 100 |
| Phenoxyethyl isobutyrate | 100 |
| Dimethyl-benzyl carbinol | 50 |
| α-Isomethylionone | 50 |
| Allylionone | 50 |
| | 850 |

*HEDIONE: origin Firmenich SA, Geneva

By adding to the above base composition, 150 g of 6-n-butyl-5,6-dihydro-2H-pyran-2-one there was obtained a novel composition whose fruity character was reminiscent of the odour of plums or apricots.

EXAMPLE 2

A base perfume composition of "fougere" type destined to the perfuming of toilet soaps was prepared by admixing the following ingredients (parts by weight):

| | |
|---|---|
| Lavandin oil | 200 |
| Geranium oil | 100 |
| Cedryl acetate | 100 |
| Absolute tree moss 50%* | 100 |

-continued

| | |
|---|---|
| Hexyl salicylate | 60 |
| Linalyl acetate | 50 |
| Linalol | 50 |
| Aspic oil | 40 |
| Hex-3-en-1-yl formate 1%* | 30 |
| Galbanum oil 10%* | 30 |
| Terpineol | 30 |
| Clove oil of Madagascar | 20 |
| Patchouli oil | 20 |
| 1,1-Dimethyl-4-acetyl-6-ter-butylindane | 20 |
| Coumarin | 20 |
| Isopropylcyclohexyl methanol | 10 |
| Cinnamic alcohol | 10 |
| Couminic aldehyde 10%. | 10 |
| | 900 |

*in diethyl phthalate

By adding to the above base 100 g of 6-n-butyl-5,6-dihydro-2H-pyran-2-one, there was obtained a novel composition whose spicy coumarinic character was more pronounced.

By replacing in the above examples, 6-n-butyl-5,6-dihydro-2H-pyran-2-one with 6-ethyl-5,6-dihydro-2H-pyran-2-one, analogous effects were observed.

What we claim is:

1. Method for enhancing, improving or modifying the odorous properties of a perfume composition which comprises adding thereto a perfuming effective amount of 6-ethyl-5,6-dihydro-2H-pyran-2-one or 6-n-butyl-5,6-dihydro-2H-pyran-2-one to impart to said perfume composition a constant and homogeneous spicy and fruity odorous note thereto.

* * * * *